United States Patent [19]

Sellner

[11] Patent Number: 4,830,381

[45] Date of Patent: May 16, 1989

[54] SIMULATED LASER WEAPON AND AMUSEMENT APPLICATION THEREFORE

[75] Inventor: Bruce A. Sellner, Faribault, Minn.

[73] Assignee: Sellner Productions, Inc., Faribault, Minn.

[21] Appl. No.: 896,786

[22] Filed: Aug. 15, 1986

[51] Int. Cl.[4] ..... A63H 33/26

[52] U.S. Cl. ..... 273/312; 434/22

[58] Field of Search ..... 273/311, 312, 310; 434/21, 22

[56] References Cited

U.S. PATENT DOCUMENTS

| | | | |
|---|---|---|---|
| 2,335,257 | 11/1943 | Binks | 273/105.1 |
| 2,392,142 | 1/1946 | Gosswiller | 35/25 |
| 2,502,834 | 4/1950 | Dreyer | 35/25 |
| 2,516,319 | 7/1950 | Hooker | 273/101.2 |
| 2,593,117 | 4/1952 | Davenport | 273/105.1 |
| 2,662,305 | 12/1953 | Alric | 35/25 |
| 2,795,057 | 6/1957 | Sohn | 35/25 |
| 3,748,751 | 7/1973 | Breglia et al. | 273/311 |
| 3,904,204 | 9/1975 | Yokoi | 434/22 |
| 3,911,598 | 10/1975 | Mohon | 35/25 |
| 3,918,714 | 11/1975 | Ceccaroni | 273/310 |
| 3,960,380 | 6/1976 | Yokoi | 273/101.1 |
| 4,123,050 | 10/1978 | Casado | 273/1 |
| 4,142,722 | 3/1979 | Romano et al. | 273/311 |
| 4,175,748 | 11/1979 | Yokoi | 273/105.1 |
| 4,177,580 | 12/1979 | Marshall et al. | 434/22 |
| 4,322,080 | 3/1982 | Pennington | 273/86 |
| 4,365,439 | 12/1982 | Litynski | 273/310 |
| 4,624,641 | 11/1986 | Gallagher | 434/21 |
| 4,642,995 | 2/1987 | Browning et al. | 52/10 |

*Primary Examiner*—Leo P. Picard

*Attorney, Agent, or Firm*—Moore & Hansen

[57] ABSTRACT

A simulated laser weapon using a halogen bulb, parabolic reflecting mirror, bulb cap, rotating aperture, air jet, barrel, and shroud to produce a pulsed envelope of substantially parallel, non-coherent light rays simulating the discharge from a high energy laser weapon being fired by and in the presence of a participant.

An amusement application for a simulated laser weapon involving several participants in an air- or spacecraft combat situation wherein each participant is seated at a station which travels circularly compared to a fixed reference point, rotates, rises and falls, and tilts, and wherein each participant's simulated laser weapon is sequentially activated and deactivated while each participant attempts to aim and fire his simulated laser weapon at targets suspended above his head.

38 Claims, 3 Drawing Sheets

SIMULATED LASER WEAPON AND AMUSEMENT APPLICATION THEREFORE

BACKGROUND OF THE INVENTION

This invention relates to the production of special effects for amusement park rides, games, and the like. More particularly, this invention reltes to an apparatus for simulating the visible and audible charcteristics of a laser weapon being fired by a player or participant, while retaining the realism which would be associated with such a laser device.

As explained hereafter, the problems incumbent in devising and using actual lasers—much less laser weapons—in confined quarters with human participants, are both so numerous and serious that an effective yet safe substitute for a laser weapon is needed for use in amusement applications.

Most laser used in scientific and industrial applications have relatively low output wattages, and have beams with a dramatic cross-sectional diameter of one-eighth inch or less. The difficulty and expense of producing a visible laser with a larger, more dramatic beam diameter approaching those shown in film and television representations increase geometrically with the beam diameter. Such a laser would have an extraordinarily high energy consumption, and would require continual recharging due to is enormous power drain for each discharge. Even at lower powers, the cost of the appropriate lasable materials, electric components, and lenses would be unduly expensive. It is also desirable to have a system which may be operated for long periods of time.

The environmental and operating conditions for the apparatus are additional factors which must be considered. Lasers, particularly high output lasers, require the temperature and humidity to be uniform and controlled. Particulate matter such as dust, smoke, or pollutants in the atmosphere can be very damaging to a laser, and require the inclusion of air filters, lens cleaners, and air-tight shrouds in the system.

It is desirable to have an apparatus which may be operated by a person of average skill and intelligence, with a minimum of instruction, but who may still improve his performance with the apparatus given the benefit of experience.

Also, accounting for the range of temperaments one might expect to find in a cross section of the ordinary population, it would be necessary to construct an apparatus which could be subjected to vigorous and at times abusive treatment.

There is, of course, also the danger of physical injury which may result from using an optical laser of any intensity. Blindness, burns, or exposure to toxic chemicals if one of the laser tubes should overheat or break are real concerns for skilled technicians using lasers in a controlled setting, much less for operators having less training and using the devices in a relatively uncontrolled manner. These problems are only compounded when an array of many lasers is contemplated, rather than a single source.

There are also difficulties in effectively simulating a pulsed laser beam—foremost being the production of parallel rays of light from a non-coherent point source. To produce a short light pulse, it is possible to turn a bulb quickly on and then off to produce a flash. Repeating this flash would create staccato bursts of light similar to those produced by the capacitors in a laser weapon being rapidly charged and discharged. However, because the filament of the bulb does not heat and cool instantaneously, there is a time delay in starting and ending each flash or pulse which tends to diminish the effect created. Such continued heating and cooling also dramatically reduces bulb life. One method to enhance the light pulse effect is to replace the bulb with an electronic strobe light or flash lamp which produces a high intensity, short duration light pulse by electric discharge in a gas. Such electronic flash units are relatively expensive, however, and because they employ a tube of gas rather than a filament, it is difficult to incorporate them in a system to produce an envelope of parallel light rays as desired. Additionally, the obstacles of limiting the afterglow of standard bulbs and simulating incremental bursts of high intensity light without allowing a viewer to detect how the effect is accomplished must be overcome. Finally, there is the problem of simultaneously timing, registering, and recording the operators' success in aiming and firing the simulated weapons at the proposed targets.

SUMMARY OF THE INVENTION

It is therefore one object of this invention to design an apparatus which may convincingly simulate the visible and audible effects of a high energy laser being discharged in the immediate presence of the viewer.

In particular, an object of this invention is to produce a pulsed beam of non-coherent, non-monochromatic visible light having a large cross-sectional diameter and substantially parallel rays without the use of a light-stimulated emission or an array of collimating lenses.

Another object of this invention is to design the above simulation apparatus so that it may be operated while aimed directly at a person, or such that several like devices may be used in a room occupied by several people, without risk of personal injury to those individuals.

Yet another object of this invention is to design the above simulation apparatus so that it will consume relatively small quantities of power, and not require time to recharge or replenish fuel cells.

An additional object of this invention is to design such a simulation apparatus which may be linked with several other like devices through a microprocessor, each of which is capable of generating discrete pulses which may be distinguished and analyzed by the microprocessor.

A further object of this invention is to design such a simulation apparatus which may be controlled and operated without extensive training or preparation, and with little supervision.

Still another object of this invention is to design the above simulation apparatus to function in adverse environments during prolonged and continuous use, while subjected to excessive physical wear and tear, potential abuse, and without requiring frequent or extensive maintenance or servicing.

A further object of this invention is to design the above simulated laser weapon to simulate a highly sophisticated apparatus, yet to have a minimum number of parts and for those parts to be mechanically simple, such that replacement or repair parts will be locally available even when the simulated laser weapon is being used in isolated areas of the country.

An additional object of this invention is to design an amusement application for the above simulated laser weapon which would permit several users to simultaneously participate in a simulation employing a plurality of simulated laser weapons in a mock combat situation involving air or spacecraft.

Described briefly, the simulated laser weapon of this invention uses a halogen bulb, parabolic reflecting mirror, bulb cap, rotating aperture, and guide tube to produce a pulsed envelope of substantially parallel, noncoherent light rays a well as the appropriate sound and other effects accompanying a simulated discharge from a high energy laser weapon being fired in the presence of a viewer.

The amusement application for said simulated laser weapon involves several users in an air or spacecraft combat situation wherein each user is seated at a station which travels circularly compared to a fixed reference point, rotates, rises and falls, and tilts, and wherein each user's laser weapon is alternately activated and deactivated while the users attempt to aim and fire the simulated laser weapon at targets simulating enemy craft suspended above their heads.

These and other objects and advantages will become apparent upon examination of the drawings and detailed description of the invention, wherein reference numerals refer to like elements throughout.

DESCRIPTION OF THE PREFERRED EMBODIMENTS

The simulated laser weapon of this invention is shown in FIGS. 1–7 and referenced generally by the numeral 10.

Figure 7:
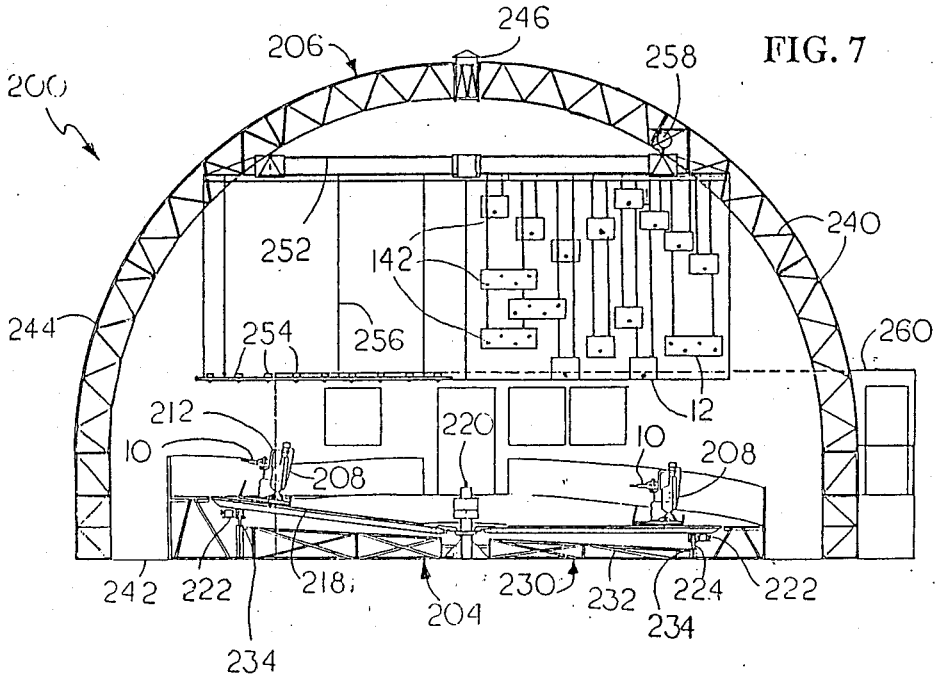
FIG. 7 is a side cross-sectional view of the amusement application for the simulated laser weapon of this invention taken through line 7—7 in the direction of the cutting plane shown in FIG. 6.

The simulated laser weapon 10 may be fired at a target 12 or an array of several targets 12 as shown in FIG. 7, may be linked together with several like simulated laser weapons 10 and controlled through a microprocessor 14 to form an amusement application 200.

The simulated laser weapon 10 consists generally of a light pulse generating apparatus 16, a sound generating apparatus 18, a mounting frame 20, a shroud 22, and a trigger mechanism 24.

Figure 1:
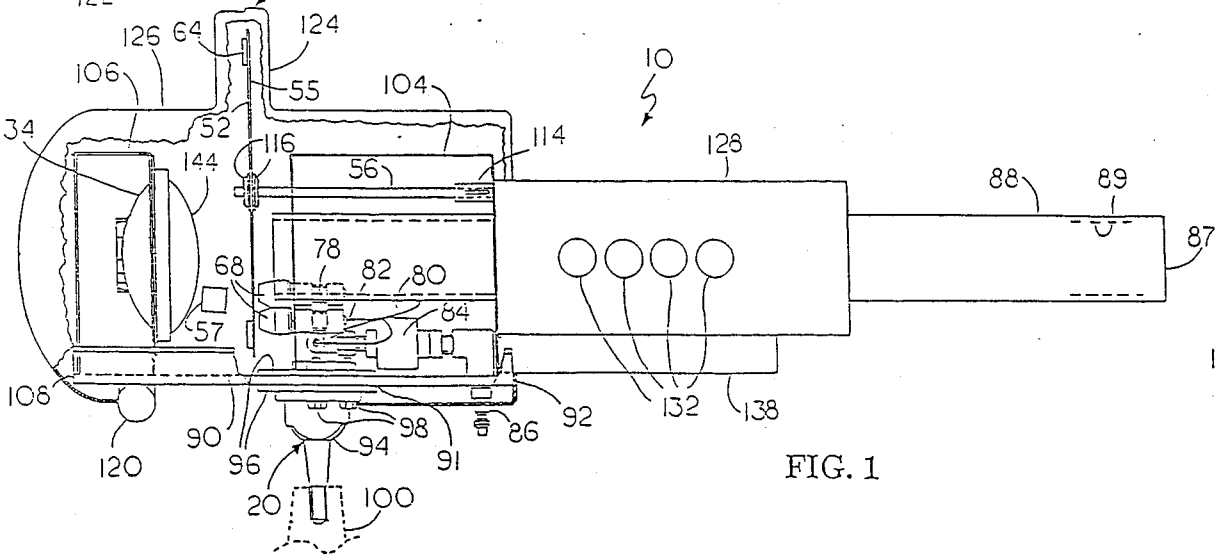
FIG. 1 is a side elevation cross section, partly cutaway view of the simulated laser weapon of this invention.
Figure 5B:
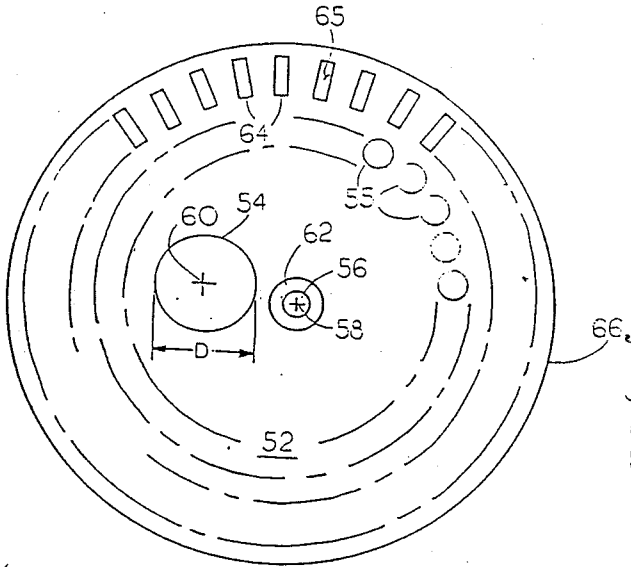
FIG. 5*b* is a front view of the rotating disk.
Figure 5A:
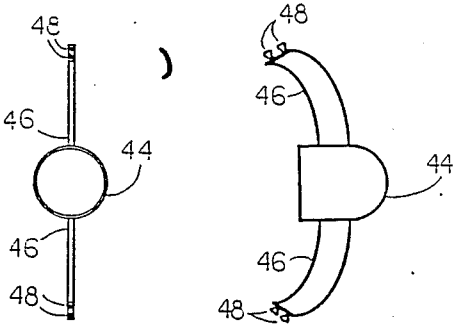
FIG. 5*a* shows rear and side views of the cap with arched arms.
Figure 5C:
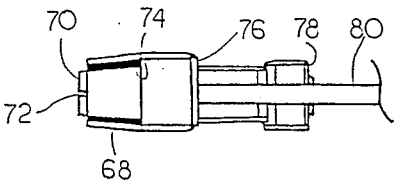
FIG. 5*c* is a cross-sectional view of the nozzle and tubing attachment.
Figure 5:
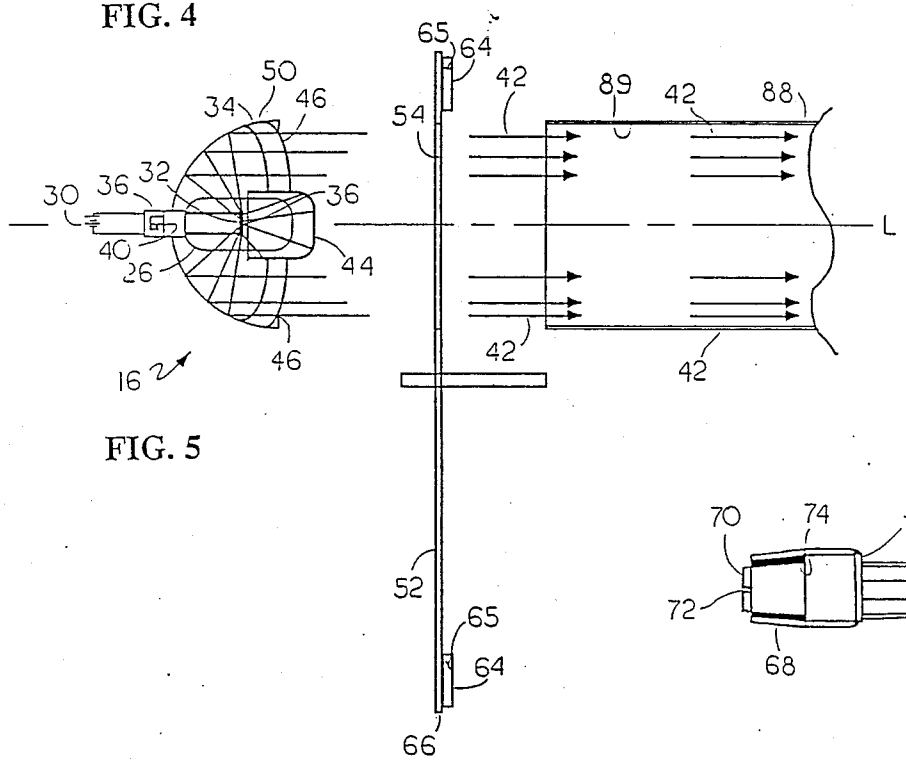
FIG. 5 is a schematic diagram of the elements of the light pulse generating apparatus showing an envelope of parallel light rays.

Referring to FIGS. 1 and 5, the light pulse generating apparatus 16 consists of a bulb 26 which will produce a bright light when connected by leads to a voltage source 30 and energized. The bulb 26 should have the candlepower or intensity sufficient to produce a shadow and a visible beam of high intensity light at a distance of approximately twenty-five to fifty feet. For purposes of approximating the path of the rays of light emanating from the bulb 26, the bulb 26 preferably has a small enough filament 32 so that it may generally approximate a point source of light. A standard 12 volt 50-watt halogen bulb having a lateral $\frac{1}{4}''$ length filament has proven suitable in these regards, although an equivalent conventional sealed-beam lamp is practical and less expensive.

The bulb 26 is mounted within a dish-shaped parabolic or concave reflecting mirror 34 with the filament 32 positioned at the focal point 36 of the parabolic or concave mirror 34, and with the base of the bulb 26 inserted in a plastic or metal bayonet type socket 38 which extends through the axis or center 40 of the mirror 39.

Figure 4:
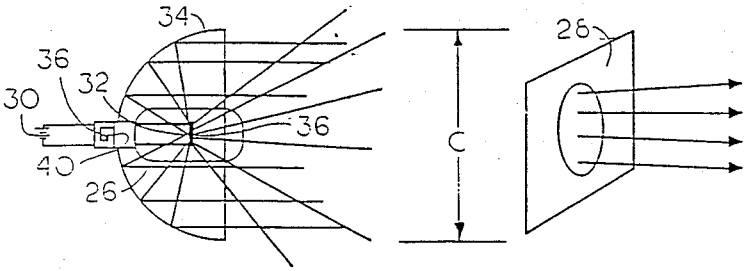
FIG. 4 is a schematic diagram of the elements of a light pulse apparatus showing divergent rays of light.

As may be seen in FIG. 4 diagramming the arrangement of the bulb 26 and reflective mirror 34, those rays of light emanating from the bulb 26 and reflecting off the mirror 34 are directed into an envelope of generally parallel light rays 42. The remaining rays which were not reflected off the mirror 34 would produce a pattern of diverging light rays. Consequently, if an aperture 28 were placed along the axis L passing through the center 40 of the mirror 34 and the filament 32 on the opposite side of the filament 32 from the mirror 34, some portion of those light rays passing through the aperture 28 would be divergent. The rays passing through the aperture 28 would only begin to approximate parallel rays if the distance between the filament 32 and aperture 28 were to approach infinity.

To produce a beam of substantially parallel light rays, one or both of two additional steps may be taken. The bulb 26 and reflective mirror 34 may be fitted with a cap 44 which extends around the bulb 26 and terminates just forwardly of the filament 32 as shown in FIG. 5. The cap 44 is made of metal having good heat resisting or heat diffusing properties, and may be darkened or anodized to absorb light. The bulb 26 is inserted into the cap 44, and the cap 44 is retained by two diverging arcuate arms 46, each of which is fixed to the cap 44. The free ends of the arms 46 are releasably attached to the reflective mirror 34 in any known manner, as seen in FIG. 5. The arcuate arms 46 may be soldered to both the cap 44 and mirror 34, or the arms 46 may be fitted with tabs 48 and the mirror 34 with slots 50 to accept and hold the tabs 48, as shown in FIG. 5a. In place of the cap 44, the surface of the bulb 26 may be partially painted or coated with an opaque, light absorbing material which will effectively duplicate the effect of the cap 44.

Alternately, to further enhance the effect produced by the light pulse generating apparatus 16 and produce a beam of substantially parallel light rays 42, a barrel 88 centered on the line L and having a bore 89 extending entirely therethrough, may be placed in the path of the light pulse so that at least a portion of the light rays pass through the bore 89 and barrel 88. The barrel 88 serves to make the envelope of parallel light rays 42 which are transmitted from the light pulse generating apparatus 16 appear to be transmitted in the form of a beam, aids in aiming the simulated laser weapon 10 or determining what direction another like simulated laser weapon 10 is being aimed, and shields the light pulse generating apparatus from view.

It is therefore desirable to make the barrel 88 of sufficient length, and position the forward end 87 of the barrel 88 a suitable distance from the bulb 26 and reflective mirror 34 so that a beam of substantially parallel light rays is produced.

To produce light pulses, a rotating disk 52, having an aperture 54 with a diameter D approximately equal to or less than the diameter C of the reflective mirror 34, is placed in the path of the light generated by the bulb 26, mirror 34, and cap 44 arrangement as shown in FIGS. 1 and 5. The disk 52 should rotate freely upon an axle 56 having an axis of rotation 58 displaced from the axis L between the center of the reflective mirror 34 and the filament 32, such that the axis L passes directly through the center of the aperture 54 in the disk 52. The disk 52 may also be painted with an optically flat black or light absorbing coating such as Nextel TM. Although more than one aperture 54 may be used, a single aperture 54 resulting in a light pulse having a duration of approximately 15% of the time required for a single rotation of the disk for any given speed of rotation of the disk 52 (a 1:6 ratio) permits those pulses to be readily distinguished by the human eye and has proven desirable. Placing the apertured disk 52 a distance from the bulb 26 and mirror 34 also serves as another means to provide a beam of substantially parallel light rays 42.

The light rays emanating from the apparatus 16 are substantially parallel, other than those errant rays reflected off elements of the apparatus 16 other than the mirror 34. The tube 88, cap 44, and apertured disk 52 serve to block most of these rays, and the remaining divergent rays are not sufficient in number or intensity to detrimentally affect the externally visible results. Making the internal components, other than the mirror 34, of a black material or covering them with a flat black or light absorbing coating such as Nextel TM adds to the effectiveness of the apparatus 16. The result is a pulse of substantially parallel con-coherent visible light rays travelling along a firing path parallel to the line L.

The apertured disk 52 is rotated by the force of an air jet blowing on or striking a series of louvres 64 which are formed as an integral part of the disk 52. A series of approximately fifty louvres 64 evenly spaced around the perimeter 66 of the disk 52 are formed by cutting the two short and one long sides of a rectangular tab through the disk 52, and then bending that partially cutaway tab along the remaining uncut side of the rectangular tab and away from the plane of the disk 52 to an angle of 30 to 45 degrees. Each louvre 64 should have a face 65 which corresponds to the planar surface of the unfolded tab, and each louvre 64 should preferably be cut and bent so that its face 65 has the same angular orientation relative to the air jet as the louvre 64 passes the air jet.

The air jet is produced by expelling pressurized gas from a compressor or tank (not shown) through one or more nozzles 68 and against the louvres 64. As shown in FIG. 5*c*, the nozzle 68 utilizes a tubing cap 70 having a small diameter orifice 72 therein, and a flared rear end 74. The tubing cap 70 is inserted into the tapered end of a tubing adapter 76, the opposite end of which is connected to a gas tubing adapter 78. A flexible length of high-pressure plastic tubing 80 is coupled to the adapter 78. To supply gas to the nozzles 68, the pieces of tubing 80 connected to each nozzle 68 are coupled through a T-connector 82. The flow of gas is controlled by a solenoid valve 84 coupled to the remaining port of the T-connector 82. The solenoid valve 84 may be selected from a variety of known devices, although a 12 volt A.C. 0.60 amp. valve with a 3/32" orifice and rate for 100 p.s.i. has been proven suitable. The solenoid 84 may be connected to the pressurized gas supply by a screw, push-, or snap-type coupler 86. The air jet serves to keep air continuously circulating around the bulb 26 and throughout the apparatus, therefore keeping it cooled and prolonging its life.

The sound generating apparatus 18 may include an electronic synthesizing circuit connected to a speaker within the laser weapon 10 to generate a limitless variety and combination of sound effects, or one may simply employ the sounds produced by the air jet passing through a second row of apertures 55 circling the rotating disk 52 and striking an air driven mechanical noise generator 57 such as a whistle. If the latter design for the sound generating apparatus is used, the sounds produced may be altered by changing the air pressure, the placement and angle of the nozzles 58, the shape of the nozzles 68, the shape, size, number, or placement of the apertures 55. A recorded loop of sound effects may also be used, however, while the electronically synthesized sounds result in a wider variety of effects with greater control of their timing. The placement of the fragile electronic components within the simulated laser weapon 10 necessarily exposes them to the risk of damage. The light pulse generating apparatus 16 and sound generating apparatus described above may be assembled on a mounting frame 20. The mounting frame 20 consists of a planar base 90 having a bearing aperture 91 near the front end 92 thereof, through which a ball joint 94 extends, the ball joint 94 being secured by a pair of locking plates 96 and bolts 98. The lower end of the ball joint 94 may be designed to fit into the upper end of a support pedestal 100 and the upper end of the ball joint 94 may be equipped with a grease valve (not shown) to permit the ball joint 94 to be periodically lubricated.

Mounted on top of the base platform 90 are a large chassis 104 and a small chassis 106. The large chassis 104 is folded into an inverted U-shaped enclosure. This large chassis 106 is welded to the base platform 90 near the front end of the base platform 92. The small chassis 106 is folded to form a smaller inverted U-shaped enclosure. This small chassis 106 is welded to the base platform 90 approximately near the rear end of the base platform 108.

Each vertical wall of the large chassis 104 has one barrel aperture to accommodate the barrel 88. Centered above each of these barrel apertures is a small hole through which the axle 56 is inserted, and secured with cotter pins 114. The rear wall of the large chassis 104 also has a pair of nozzle mounting apertures 56 and which accept the nozzles 68, which are secured with a known fastener 116 such as a locking collar. The small chassis 106 has a hole suitably placed for mounting the bayonet type socket 38 and reflecting mirror 34.

The mounting frame 20 may also include a pair of handlebars 120 which extend outwardly from below each side of the base platform 90, and are securely welded or bolted to the base platform 90 so they may be used to aim the laser weapon 10. Each end of the handlebar 120 is curved upward, and covered with a plastic or rubber handgrip 122.

The light pulse generating apparatus 16 and mounting frame 20 are covered by a protective shroud 22. The shroud 22 consists of a front cowling 124 and a rear cowling 126 molded from a reinforced fiberglass, and shaped both to fit over the enclosed components and to present an aesthetically pleasing design which simulates that expected of a laser weapon. The front cowling 124 may be made so that it is inserted inside an overlapping portion of the rear cowling 126, or vice versa. The cowlings 124, 126 have an opening in the bottom through which extend the ball joint 94, base platform 90, electric wiring, and snap coupler 86 for the pressurized gas supply lines. The shroud 22 may also be equipped with an enlarged, rigid outer tube 128 extending forwardly of and concentric with a portion of the barrel 88. The front end of the outer tube 128 is retained by a reducing fitting 130 fastened to both the outer tube 128 and barrel 88 by gluing or screws. The outer tube 128 may have a line of apertures 132 to provide a look similar to that of heat diffuser used with such a weapon.

To turn on the light pulse generating apparatus 16 and register such activation on the microprocessor 14 responsive to the user's direction, the laser weapon 10 is equipped with a trigger mechanism 24 formed by one or more push-button contact switches 134 positioned in the top of the handgrips 122 where they may be easily reached by the user, and electrically connected to the microprocessor 14 and other components of the laser weapon 10.

Figure 3:
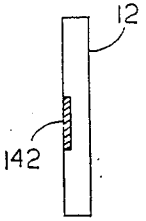
FIG. 3 is a front elevation view of the simulated laser weapon shown in FIG. 1.
Figure 2:
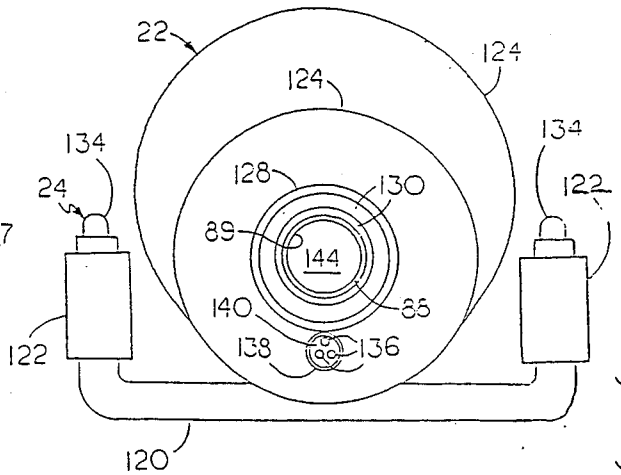
FIG. 2 is a top cross section, partly cutaway view of the simulated laser weapon shown in FIG. 1.
Figure 2:
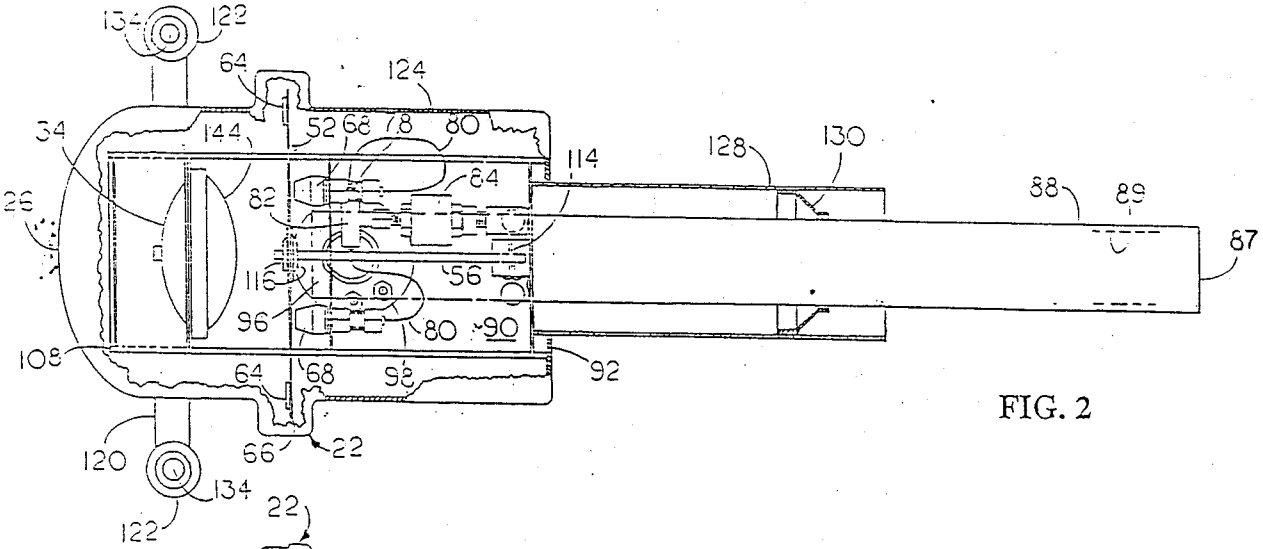

While the pulsed light beam could be used to register hits upon the targets 12, where one or a few weapons 10 are used, the ambient or special effects lighting desired to accompany the effect when many weapons 10 are used, requires an alternate target registration system. One source of alternate target registration is obtained using a separate beam of electromagnetic energy generated while the pulsed light beam is being generated. The infrared target beam may be emitted from an infrared source, here shown as three infrared light emitting diodes 136 placed in a triangular array within a diode tube 138 and supported by a circuit board 140 which is positioned vertically over the rear end of the tube 138. The tube 138 is mounted parallel to the barrel 88 and tangent to the lower middle portion of the outer tube 128 as shown in FIGS. 1 and 3. The tube 138 acts in the same manner as the barrel 88 to ensure that the infrared electromagnetic radiation emitted by the LEDs 136 is transmitted as a beam in a direction parallel to the direction of the firing path L of the envelope of substantially parallel light rays 42 passing through the barrel 88.

The infrared light produced by the LEDs 136 and transmitted through the tube 138 strikes an infrared sensitive photoelectric cell 142 positioned on and affixed to the surface of the target 12 and electrically connected to the microprocessor 14. When the user aims the laser weapon 10 accurately at a target 12 using an external sight or by visually following the path of the light pulses, the infrared light from the LEDs 136 would strike the photoelectric cells 142 which would guarantee an electrical response for the microprocessor 14 to record as a hit on the target for the user.

Each light pulse generating apparatus 16 may be equipped with one or more of several varied color filters 144 so that the visual effect is enhanced, and the pulses or beams from one user's laser weapon 10 may be readily distinguished from those emanating from another to aid the users in aiming.

Figure 6:
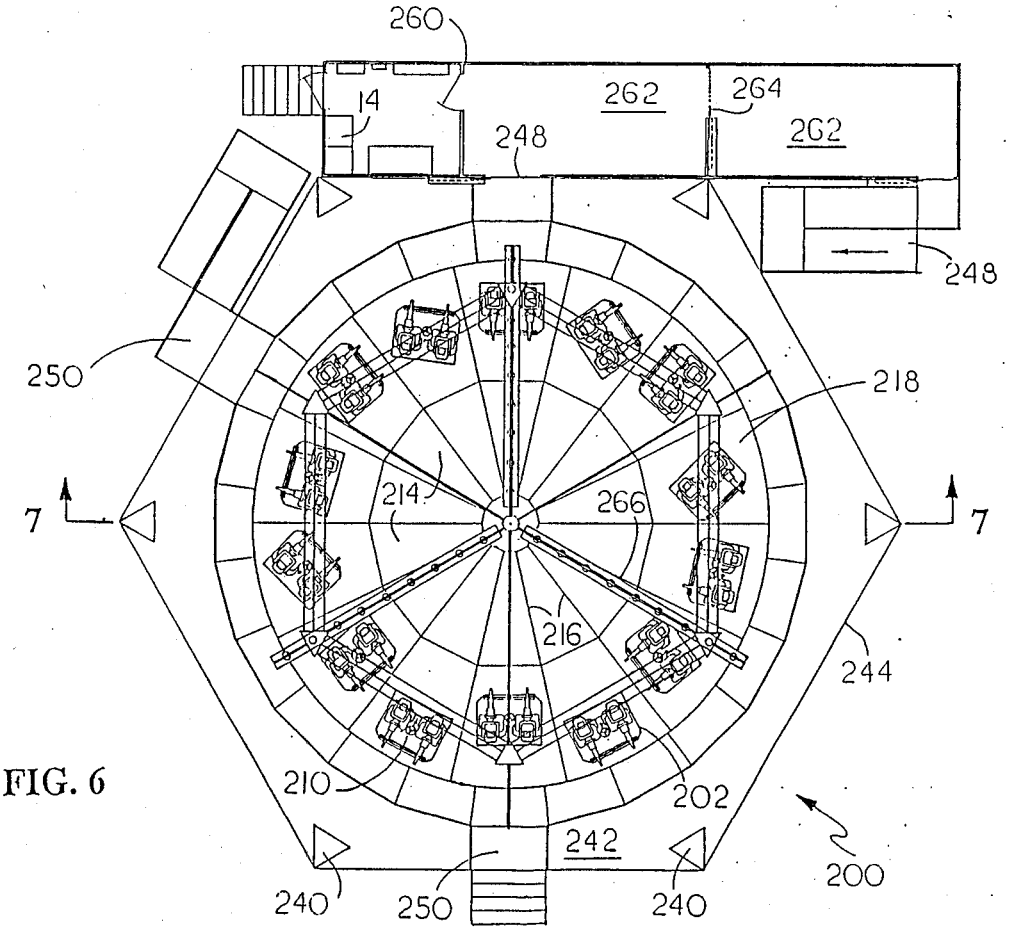
FIG. 6 is a top plan view of the amusement application for the simulated laser weapon of this invention.

Referring to FIGS. 6 and 7, the shown amusement application 200 utilizes a plurality of moving stations 202, each station 202 capable of accommodating two users, each station 202 moving relative to some fixed reference point such as a target 12, and each supported on a platform 204 and contained within a structure 206.

Each of the shown stations 202 includes two seats 208 which may be rotated to the left or right of center, and tipped rearwardly against spring pressure. The station 202 may be rotated mechanically in some predetermined pattern about a vertical axis of rotation, as the station 202 rotates, or control over rotation may be left to the participants, by allowing them to grasp an optional hand wheel 210 located between the seats 208 and rotate the station 202. A gun support arm 212 is attached to each seat 208 and has a support pedestal 100 at the end opposite the seat 208 to accommodate the lower end of the ball joint 94 of the laser weapon 10. The gun support arm 212 may be pivoted upward to a position above the seat 208 when users are entering or leaving the station 202, and pivoted downward in front of the seat 208 to act as a safety restraint for the user.

The bottom of each station 202 is mounted to a platform 204 for swinging about an upright axis passing through wheel 210. The stations 202 may be coupled to a mechanical drive source to produce rotation, or the stations 202 may be mounted on bearings which allow the participants to control the rotation by use of the optional hand wheel 210. The platform 204 consists of a number of wedge shaped sections 214 hingedly connected along their side edges 216 to form a circular turntable 218, each of the sections 214 capable of moving upward or downward as the entire turntable 218 rotates about its central axis 220. In one embodiment of the amusement apparatus 200, fourteen sections 214 and stations 202 are employed to accommodate twenty-eight users on a smaller diameter turntable 218, whereas in a larger embodiment twenty-eight sections 214 and stations 202 are employed to accommodate fifty-six users. The turntable 218 is rotated by a plurality of electrically driven drive trollies 222. The motor speed is regulated by a variable frequency controller so that soft starts and stops may be easily achieved. It is understood that this drive arrangement is common to those used to propel similar amusement park rides, such as those sold under the trade name, Tilt-A-Whirl TM, and manufactured by Sellner Manufacturing Company of Faribault, Minn.

The turntable is supported by a base 230 fabricated out of standard shape sections of structural gridwork 232 pinned together for ease of assembly, disassembly and transport. The drive wheel 224 of each trolley 222 runs along the top of an undulating track 234 which circles the perimeter of the gridwork 232 of the base 230. The track has portions which are elevated to produce a "hill and valley" effect, so that as the turntable 218 rotates, the sections 214 of the platform 204 supporting the stations 202 rise and fall.

The stations 202 and platform 204 are contained within a dome shaped structure 206 to protect the equipment and users from the elements, and to provide the necessary light and environmental conditions to enhance the effects created.

The structure 206 consists of a network of interconnected, arched gridwork of structural beams 240 extending upward from the ground or floor 242 at the corners of a hexagon to form a flat walled half-sphere, covered with a durable plastic, foam, or metal membrane 244, and equipped with the necessary ventilators 246, entrances 248, and exits 250.

Suspended under the structural beams 240 is a fly structure 252. The fly structure 252 supports a bank of house lights 254, and a plurality of targets 12, on cables 256. The fly structure 252 is connected to one or more winches 258 so that the targets 12 and house lights 254 may be lowered for maintenance.

The targets 12 are arranged in a pattern of three equilaterally spaced partitions 266, so that the user in each station 202 effectively travels fro one bank of targets 12 to another in a repeating and intermittent sequence. This enhances the user's ability to focus on certain targets 12 which are activated, and then refocus his attention on the next set of targets 12 as they approach. It also forces the user to continually adjust his position and aim.

A control building 260 housing the microprocessor 14, as well as briefing rooms 262 and simulated airlock entryway 264 are connected to the domed structure 206.

The effectiveness of the simulation may be enhanced by filling the structure 206 with clouds of a harmless smoke or like substance which will permit the pulses of light rays to be easily visible and more readily aimed.

In operation, users enter the structure 206 through the briefing rooms 262 and airlock 264 in the control building 260. They are seated at the stations 202, and the gun support arms 212 are lowered and locked in place. The house lights 254 dim and the turntable 218 begins to rotate and accelerate, carrying each station 202 around in a circle and up and down over the hills and valleys of the undulating track 234 under the targets 12 suspended above the heads of the users. As the targets 12, shaped to resemble various views of enemy or friendly air- or spacecraft, are selectively illuminated, the users swivel their seats 208 and tip them back in order to aim their laser weapons 10 at the lighted targets 12. The users depress the trigger mechanisms 134 on the handlebars 120 of their lasers weapons 10 in order to fire at a target 12. Depressing the trigger mechanism 134 activates the light pulse generating apparatus 16 and sound generating apparatus 18. Air passes through the nozzles 68 creating air jets which rotate the disk 52 and activate the mechanical sound generating apparatus. Soon, the structure 206 is filled with the visual, aural, and sensor display simulating that of spaceflight combined with combat using laser weapons.

To provide for electronic scorekeeping, the infrared LEDs 136 on one laser weapon 10 are activated for a discrete time span. Any hits recorded by the microprocessor 14 during that discrete time span are tallied for the user whose weapon 10 is activated. Those LEDs 136 on that laser weapon 10 are then deactivated, and the LEDs 136 on the next adjacent laser weapon 10 are activated for an equal time span. This procedure is repeated until each laser weapon 10 has been activated and then the cycle is repeated. In this way, with the entire cycle being repeated approximately several times per second, no one user is aware that his laser weapon 10 is intermittently being activated and deactivated. Thus, after the simulation has proceeded for a certain predetermined duration, or after one user achieves a particular score, the simulation will end and each user may be given a score sheet printed out by the microprocessor identifying their score, the types and numbers of targets they hit, their accuracy, etc., as they leave the structure 206.

This process of registering his upon the targets 12 may thus encompass several different activities performed by the microprocessor 14, including: the activation of at least one beam (either visible or infrared); timing that beam or synchronizing it with the activation of targets 12; discriminating and recording when an activated beam is directed sufficiently closer to or at those targets 12 such that it would constitute a hit at that time; and analyzing or otherwise processing the results of several repeated attempts over a period of time by correlating the data provided and calculating such results as the number of successful hits, the hit to miss ratio or percentage, the score values of the hits and misses, and the composite scores for all the participants including a high score for the day.

It is understood that various adaptations may be made to alter the nature of the challenge and effect of the application, such as removing a portion of the user's or participant's control over determining the direction in which the beam is aimed or transmitted, requiring that more than one participant—or each participant at a station—act together as a team or in concert to aim and fire the simulated laser weapon, giving the participants prompts or instructions from a display as they are engaged in the simulation, having "friendly" targets which must be avoided as well as "enemy" targets, or varying the point values of the targets. A beam other than visible or infrared light may be used to register hits on the targets, and variable frequencies of such a beam then used to permit continuous firing by the participants.

It is further understood that changes and modifications in the design and operation of the above simulated laser weapon and amusement application therefor may be made without departing from the spirit and scope of the invention as described in the claims which follow.

What is claimed is:

1. A simulated laser weapon connectable to a power source and usable on a surface by a participant to aim and fire at a target said simulated weapon comprising:

a frame;

means connectable to the power source for producing and transmitting a beam of substantially parallel non-coherent visible light rays, including a light source carried by said frame for producing non-coherent visible light waves for transmission to the target; means movably mounting said frame and supportable on the surface to permit the participant to move said frame to cause said beam to strike the target; and means for selectively producing and transmitting a second beam detectable at a distance from the simulated laser weapon, said means for producing and transmitting said second beam including:

a source for selectively producing electromagnetic radiation;

means for directing the transmission of said electromagnetic radiation as a beam in a direction substantially parallel to the envelope of substantially parallel light rays; and means for selectively activating said source for producing electromagnetic radiation.

2. The simulated laser weapon of claim 1 wherein said means for producing and transmitting a beam of substantially parallel, non-coherent visible light rays further includes a light redirecting device for redirecting a portion of said light waves emanating from said light source into an envelope of substantially parallel light rays travelling along and parallel to a firing path, said light redirecting device carried by said frame and a light blocking device for continuously blocking the transmission of those light waves not redirected into said envelope by said redirecting device, said light blocking device positioned between said light source and the target generally along said firing path and generally within said envelope of substantially parallel light rays.

3. The simulated laser weapon of claim 2 further including; shroud means, said shroud means substantially surrounding said light source, said light redirecting means, and said light blocking device, said shroud means defining at least one aperture extending through the surface thereof and at least a portion of said aperture aligned along said line of transmission of said envelope of substantially parallel light rays, such that at least a portion of said envelope of substantially parallel light rays passes through said aperture.

4. The simulated laser weapon of claim 3 further comprising:

means for detecting the second beam, said detection means positionable on the target, and said detection means being connectable to the power source and responsive to the second beam to generate an electrical response when the second beam strikes said detection means; and means for electrically coupling said detection means and the means for producing and transmitting the second beam whereby the second beam may be used for registering when the beam of substantially parallel non-coherent visible light rays are being transmitted and strike said detection means.

5. The simulated laser weapon of claim 4 further comprising:

means for converting the envelope of substantially parallel light rays into pulsed light rays, said converting means having a second light blocking device capable of alternately blocking and transmitting the substantially parallel light rays redirected from the light redirecting device, whereby the light rays which are transmitted by said second light blocking device are transmitted as pulses.

6. The simulated laser weapon of claim 5 wherein:

the means for converting the envelope of substantially parallel light rays into pulses comprises a light-blocking disk, said disk rotatably mounted in the path of the envelope of substantially parallel light rays redirected from the light redirecting device;

said disk having an axis of rotation; and said disk having an aperture extending through the surface thereof, said aperture being radially displaced from said axis of rotation and alignable in the path of and along the firing path of the envelope of substantially parallel light rays redirected from the light redirecting device as said disk rotates, whereby the rotation of the disk causes the disk to alternately block the transmission of the envelope of light rays and bring the aperture into alignment with the path of the envelope of light rays to permit the light rays to be transmitted as pulses.

7. The simulated laser weapon of claim 6 wherein the second beam is composed of infrared electromagnetic radiation.

8. The simulated laser weapon of claim 7 further comprising:

switch means for selectively activating and deactivating the transmission of said pulsed beam responsive to the participant.

9. The simulated laser weapon of claim 8 wherein the means for electrically coupling the detection means and the means for producing and transmitting the second beam includes a microprocessor circuit, said circuit electrically connected to the means for producing the second beam and electrically connected to detection means, said microprocessor being capable of sequentially activating and deactivating the second beam for a discrete time period, and said microprocessor also being capable of discriminating when the second beam and the detection means on the target are both activated during said discrete time period, and correlating the activation of the second beam with the activation of the detection means by the second beam.

10. A simulated laser weapon connectable to a power source and usable on a surface by a participant to aim and fire at a target, said simulated laser weapon comprising:

a frame;

means connectable to said power source and transmitting a beam of substantially parallel non-coherent visible rays, said means including a light source for producing non-coherent visible light waves carried by said frame; a light redirecting device for redirecting a portion of said light rays emanating from said light source into an envelope of substantially parallel light rays travelling along and parallel to a firing path, said light redirecting device carried by said frame, and further including a barrel for transmitting said envelope of substantially parallel light rays as a beam; said barrel further defining a bore extending entirely through said barrel, said bore being aligned generally longitudinally to and along said firing path such that at least a portion of said envelope of substantially parallel light rays passes through said bore; shroud means, said shroud means substantially surrounding said light source and said light redirecting device, said shroud means defining at least one aperture extending through the surface thereof and at least a portion of said aperture aligned along said firing path of said envelope of substantially parallel light rays, and said aperture communicating with said bore, such that at least a portion of said envelope of substantially parallel light rays passes through said aperture;

means movably mounting said frame and supportable on the surface to permit the participant to move said frame to cause said beam to strike the target; and means for selectively producing and transmitting a second beam detectable at a distance from the simulated laser weapon, said means for producing and transmitting said second beam including:

a source for selectively producing electromagnetic radiation;

means for directing the transmission of said electromagnetic radiation as a beam in a direction substantially parallel to the envelope of substantially parallel light rays; and means for selectively activating said source for producing electromagnetic radiation.

11. The simulated laser weapon of claim 10 further comprising:

means for detecting the second beam, said detection means positionable on the target, and said detection means being connectable to the power source responsive to the second beam to generate an electrical response when the second beam strikes said detection means; and means for electrically coupling said detection means and the means for producing and transmitting the second beam whereby the second beam may be used for registering when the beam of substantially parallel non-coherent visible light rays are being transmitted and strike said detection means.

12. The simulated laser weapon of claim 11 further comprising:

means for converting the envelope of substantially parallel light rays into pulsed light rays, said converting means having a light blocking device capable of alternately blocking and transmitting the substantially parallel light rays redirected from the light redirecting device, whereby the light rays which are transmitted by said light blocking device are transmitted as pulses.

13. The simulated laser weapon of claim 12 wherein:

the means for converting the envelope of substantially parallel light rays into pulses comprises a light-blocking disk, said disk rotatably mounted in the path of the envelope of substantially parallel light rays redirected from the light redirecting device;

said disk having an axis of rotation; and said disk having an aperture extending through the surface thereof, said aperture being radially displaced from said axis of rotation and alignable in the path of and along the firing path of the envelope of substantially parallel light rays redirected from the light redirecting device as said disk rotates, whereby the rotation of the disk causes the disk to alternately block the transmission of the envelope of light rays and bring the aperture into alignment with the path of the envelope of light rays to permit the light rays to be transmitted as pulses.

14. The simulated laser weapon of claim 13 wherein the second beam is of infrared electromagnetic radiation.

15. The simulated laser weapon of claim 14 further comprising:

switch means for selectively activating and deactivating the transmission of said pulsed beam responsive to the participant.

16. The simulated laser weapon of claim 15 wherein the means for electrically coupling the detection means and the means for producing and transmitting the second beam includes a microprocessor circuit, said circuit electrically connected to the means for producing the second beam and electrically connected to detection means, said microprocessor being capable of sequentially activating and deactivating the second beam for a discrete time period, and said microprocessor also being capable of discriminating when the second beam and the detection means on the target are both activated during said discrete time period, and correlating the activation of the second beam with the activation of the detection means by the second beam.

17. A simulated laser weapon connectable to a power source and usable on a surface by a participant to aim and fire at a target, said simulated laser weapon comprising:

a frame;

means connectable to the power source for producing and transmitting a beam of substantially parallel non-coherent visible light rays, said means including a light source for producing non-coherent visible light waves carried by said frame, a light redirecting device for redirecting a portion of said light waves emanating from said light source into an envelope of substantially parallel light rays travelling along and parallel to a firing path, said light redirecting device carried by said frame, and a light blocking device for continuously blocking the transmission of those light waves not redirected into said envelope by said redirecting device, said light blocking device positioned between said light source and the target generally along said firing path and generally within said envelope of substantially parallel light rays;

a barrel for transmitting said envelope of substantially parallel light rays as a beam, said barrel further defining a bore extending entirely through said barrel, said bore being aligned generally longitudinally to and along said firing path such that at least a portion of said envelope of substantially parallel light rays passes through said bore;

shroud means, said shroud means substantially surrounding said light source, said light redirecting means, and said light blocking device, said shroud means defining at least one aperture extending through the surface thereof and at least a portion of said aperture aligned along said firing path of said envelope of substantially parallel light rays, and said aperture communicating with said bore, such that at least a portion of said envelope of substantially parallel light rays passes through said aperture;

means movably mounting said frame and supportable on the surface to permit the participant to move said frame to cause said beam to strike the target; and means for selectively producing and transmitting a second beam detectable at a distance from the simulated laser weapon, said means for producing and transmitting said second beam including:

a source for selectively producing electromagnetic radiation;

means for directing the transmission of said electromagnetic radiation as a beam in a direction substantially parallel to the envelope of substantially parallel light rays; and means for selectively activating said source for producing electromagnetic radiation.

18. The simulated laser weapon of claim 17 further comprising:

means for detecting the second beam, said detection means positionable on the target, and said detection means being connectable to the power source and responsive to the second beam to generate an electrical response when the second beam strikes said detection means; and means for electrically coupling said detection means and the means for producing and transmitting the second beam whereby the second beam may be used for registering when the beam of substantially parallel non-coherent visible light rays are being transmitted and strike said detection means.

19. The simulated laser weapon of claim 18 further comprising:

means for converting the envelope of substantially parallel light rays into pulsed light rays, said converting means having a second light blocking device capable of alternately blocking and transmitting the substantially parallel light rays redirected from the light redirecting device, whereby the light rays which are transmitted by said second light blocking device are transmitted as pulses.

20. The simulated laser weapon of claim 19 wherein:

the means for converting the envelope of substantially parallel light rays into pulses comprises a light-blocking disk, said disk rotatably mounted in the path of the envelope of substantially parallel light rays redirected from the light redirecting device;

said disk having an axis of rotation; and said disk having an aperture extending through the surface thereof, said aperture being radially displaced from said axis of rotation and alignable in the path of and along the firing path of the envelope of substantially parallel light rays redirected from the light redirecting device as said disk rotates, whereby the rotation of the disk causes the disk to alternately block the transmission of the envelope of light rays and bring the aperture into alignment with the path of the envelope of light rays to permit the light rays to be transmitted as pulses.

21. The simulated laser weapon of claim 20 wherein the second beam is composed of infrared electromagnetic radiation.

22. The simulated laser weapon of claim 21 further comprising:

switch means for selectively activating and deactivating the transmission of said pulsed beam responsive to the participant.

23. The simulated laser weapon of claim 22 wherein the means for electrically coupling the detection means and the means for producing and transmitting the second beam includes a microprocessor circuit, said circuit electrically connected to the means for producing the second beam and electrically connected to detection means, said microprocessor being capable of sequentially activating and deactivating the second beam for a discrete time period, and said microprocessor also being capable of discriminating when the second beam and the detection means on the target are both activated during said discrete time period, and correlating the activation of the second beam with the activation of the detection means by the second beam.

24. The simulated laser weapon of claims 2 or 17 further comprising:

means for converting the envelope of substantially parallel light rays into pulsed light rays, said converting means having a second light blocking device capable of alternately blocking and transmitting the substantially parallel light rays redirected from the light redirecting device, whereby the light rays which are transmitted by said second light blocking device are transmitted as pulses.

25. The simulated laser weapon of claim 24 wherein:

the means for converting the envelope of substantially parallel light rays into pulses comprises a light-blocking disk, said disk rotatably mounted in the path of the envelope of substantially parallel light rays redirected from the light redirecting device;

said disk having an axis of rotation; and said disk having an aperture extending through the surface thereof, said aperture being radially displaced from said axis of rotation and alignable in the path of and along the firing path of the envelope of substantially parallel light rays redirected from the light redirecting device as said disk rotates, whereby the rotation of the disk causes the disk to alternately block the transmission of the envelope of light rays and bring the aperture into alignment with the path of the envelope of light rays to permit the light rays to be transmitted as pulses.

26. The simulated laser weapon of claim 25 further comprising:

a plurality of louvres, said louvres being attached to the rotating disk and moving in a generally circular path as the disk rotates, and each said louvre having a face oriented angularly to the disk;

at least one nozzle, said nozzle having at least one orifice being directed toward said louvres on the rotating disk, each said louvre passing said nozzle as said louvre moves along said path; and a gas supply for supplying pressurized gas to said nozzle, said gas supply being connected in fluid communication to said nozzle such that said pressurized gas from said gas supply may be selectively expelled from said nozzle through said orifice in the form of a gas jet, said gas jet being directed to strike said faces of said louvres as said louvres pass said nozzle, whereby the gas jet expelled from the orifice of the nozzle strikes the faces of the louvres which are oriented angularly to the rotating disk, and the force of the expelled gas jet upon the louvres causes the disk to rotate.

27. The simulated laser weapon of claim 26 further comprising:

means for selectively producing and transmitting a second beam detectable at a distance from the simulated laser weapon, said means for producing and transmitting said second beam include:

a source for selectively producing electromagnetic radiation;

means for directing the transmission of said electromagnetic radiation as a beam in a direction substantially parallel to the envelope of substantially parallel light rays; and means for selectively activating said source for producing electromagnetic radiation.

28. The simulated laser weapon of claim 27 further comprising:

means for detecting the second beam, said detection means connectable to the power source and positionable on the target, and said detection means being responsive to the second beam to generate an electrical response when the second beam strikes said detection means; and means for electrically coupling said detection means and the means for producing and transmitting the second beam whereby the second beam may be used for registering when the beam of substantially parallel non-coherent visible light rays are being transmitted and are directed at the target.

29. The simulated laser weapon of claim 28 further comprising:

a second nozzle having a second orifice, said second nozzle connected in fluid communication to the supply of pressurized gas such that the pressurized gas from the supply may be selectively expelled from said second nozzle through said second orifice in the form of a second gas jet;

a plurality of second apertures extending through the surface of the rotating disk, each said second aperture moving in a circular path as the disk rotates, said apertures such that the second gas jet passes through said second apertures as each said second aperture passes said second nozzle as said second aperture moves in said circular path; and a sound generating device, said sound generating device producing a sound responsive to said second gas jet striking said sound generating device as said second gas jet passes through said second apertures, said sound generating device being selectively activated during the time that the beam of substantially parallel light rays is being transmitted.

30. The simulated laser weapon of claim 29 wherein the sound generating device is activated by the beam of substantially parallel light rays.

31. The simulated laser weapon of claim 30 wherein the gas jet circulates gas throughout a substantial portion of said shroud means and particularly that portion of the shroud means surrounding the light source, the gas jet thereby cooling the light source.

32. A simulated laser weapon connectable to a power source and usable on a surface by a participant to aim and fire at a target, said simulated laser weapon comprising:

a frame;

means connectable to the power source for producing and transmitting a beam of substantially parallel non-coherent visible light rays, said means including a light source for producing non-coherent visible light waves carried by said frame, a light redirecting device for redirecting a portion of said light waves emanating from said light source into an envelope of substantially parallel light rays travelling along and parallel to a firing path, said light redirecting device carried by said frame, and a light blocking device for continuously blocking the transmission of those light waves not redirected into said envelope by said redirecting device, said light blocking device positioned between said light source and the proposed target generally along said firing path and generally within said envelope of substantially parallel light rays;

a barrel for transmitting said envelope of substantially parallel light rays as a beam, said barrel further defining a bore extending entirely through said barrel, said bore being aligned generally longitudinally to and along said firing path such that at least a portion of said envelope of substantially parallel light rays passes through said bore;

shroud means, said shroud means substantially surrounding said light source, said light redirecting means, and said light blocking device, said shroud means defining at least one aperture extending through the surface thereof and at least a portion of said aperture aligned along said line of transmission of said envelope of substantially parallel light rays and said aperture communicating with said bore, such that at least a portion of said envelope of substantially parallel light rays passes through said aperture;

means movably mounting said frame and supportable on the surface to permit the participant to move said frame to cause said beam to strike the target; and, means for selectively producing and transmitting a second beam detectable at a distance from the simulated laser weapon, said means for producing and transmitting said second beam including:

a source for selectively producing electromagnetic radiation;

means for directing the transmission of said electromagnetic radiation as a beam in a direction substantially parallel to the envelope of substantially parallel light rays; and means for selectively activating said source for producing electromagnetic radiation.

33. The simulated laser weapon of claim 32 further comprising:

means for detecting the second beam, said detection means positionable on the target, and said detection means being connectable to the power source and responsive to the second beam to generate an electrical response when the second beam strikes said detection means; and means for electrically coupling said detection means and the means for producing and transmitting the second beam whereby the second beam may be used for registering when the beam of substantially parallel non-coherent visible light rays are being transmitted and strike said detection means.

34. The simulated laser weapon of claim 33 further comprising:

means for converting the envelope of substantially parallel light rays into pulsed light rays, said converting means having a second light blocking device capable of alternately blocking and transmitting the substantially parallel light rays redirected from the light redirecting device, whereby the light rays which are transmitted by said second light blocking device are transmitted as pulses.

35. The simulated laser weapon of claim 34 wherein:

the means for converting the envelope of substantially parallel light rays into pulses comprises a light-blocking disk, said disk rotatably mounted in the path of the envelope of substantially parallel light rays redirected from the light redirecting device;

said disk having an axis of rotation; and said disk having an aperture extending through the surface thereof, said aperture being radially displaced from said axis of rotation and alignable in the path of and along the firing path of the envelope of substantially parallel light rays redirected from the light redirecting device as said disk rotates, whereby the rotation of the disk causes the disk to alternately block the transmission of the envelope of light rays and bring the aperture into alignment with the path of the envelope of light rays to permit the light rays to be transmitted as pulses.

36. The simulated laser weapon of claim 35 wherein the second beam is composed of infrared electromagnetic radiation.

37. The simulated laser weapon of claim 36 further comprising: switch means for selectively activating and deactivating the transmission of said pulsed beam responsive to the participant.

38. The simulated laser weapon of claim 37 wherein the means for electrically coupling the detection means and the means for producing and transmitting the second beam includes a microprocessor circuit, said circuit electrically connected to the means for producing the second beam and electrically connected to detection means, said microprocessor being capable of sequentially activating and deactivating the second beam for a discrete time period, and said microprocessor also being capable of discriminating when the second beam and the detection means on the target are both activated during said discrete time period, and correlating the activation of the second beam with the activation of the detection means by the second beam.

* * * * *